US009186014B2

(12) United States Patent
Patchen et al.

(10) Patent No.: US 9,186,014 B2
(45) Date of Patent: Nov. 17, 2015

(54) APPARATUS FOR HANGING OR DISPLAYING LIGHTS, ORNAMENTS, OR OTHER DECORATIVE ELEMENTS

(71) Applicants: Alex Gregg Patchen, New York, NY (US); Michael Scott Patchen, Greenwich, CT (US)

(72) Inventors: Alex Gregg Patchen, New York, NY (US); Michael Scott Patchen, Greenwich, CT (US)

( * ) Notice: Subject to any disclaimer, the term of this patent is extended or adjusted under 35 U.S.C. 154(b) by 59 days.

(21) Appl. No.: 13/940,390

(22) Filed: Jul. 12, 2013

(65) Prior Publication Data

US 2014/0017421 A1 Jan. 16, 2014

Related U.S. Application Data

(60) Provisional application No. 61/670,902, filed on Jul. 12, 2012.

(51) Int. Cl.
*F21V 33/00* (2006.01)
*A47G 33/06* (2006.01)
*A47G 33/00* (2006.01)

(52) U.S. Cl.
CPC ..... *A47G 33/06* (2013.01); *A47G 33/00* (2013.01)

(58) Field of Classification Search
USPC ..... 362/565
See application file for complete search history.

(56) References Cited

U.S. PATENT DOCUMENTS

| | | | | |
|---|---|---|---|---|
| 2,149,165 | A * | 2/1939 | Dowd | 135/158 |
| 2,414,866 | A * | 1/1947 | Glaser | 362/410 |
| 3,191,020 | A * | 6/1965 | Miller | 206/223 |
| 3,264,783 | A * | 8/1966 | Bayliss | 47/45 |
| 4,034,215 | A * | 7/1977 | Hashimoto | 362/565 |
| 5,647,166 | A * | 7/1997 | Neff | 47/45 |
| 5,776,560 | A * | 7/1998 | Kori et al. | 428/20 |
| 6,210,022 | B1 * | 4/2001 | Howard | 362/235 |
| 6,237,882 | B1 * | 5/2001 | DiMuzio | 248/175 |
| 7,789,542 | B2 * | 9/2010 | Lederer | 362/392 |
| 8,678,615 | B1 * | 3/2014 | Ko | 362/234 |
| 2004/0137172 | A1 * | 7/2004 | Johnson et al. | 428/18 |
| 2006/0044790 | A1 * | 3/2006 | Crawley | 362/153 |
| 2007/0147028 | A1 * | 6/2007 | Chan | 362/123 |
| 2008/0028677 | A1 * | 2/2008 | Shelton | 47/46 |
| 2010/0027250 | A1 * | 2/2010 | Chen et al. | 362/184 |
| 2010/0053991 | A1 * | 3/2010 | Boggs | 362/565 |
| 2012/0055056 | A1 * | 3/2012 | Olson | 40/563 |
| 2012/0285912 | A1 * | 11/2012 | Koessl | 211/70.6 |

FOREIGN PATENT DOCUMENTS

WO WO 2010147626 A2 * 12/2010

* cited by examiner

*Primary Examiner* — Joseph L Williams
(74) *Attorney, Agent, or Firm* — Michael Tieff

(57) ABSTRACT

In an implementation, an apparatus is provided. The apparatus includes a base and a plurality of branches to create an artistic design. The apparatus may require assembly, and when assembled the apparatus becomes a rigid, stable and free-standing structure of a shape that does not naturally occur. The apparatus does not replicate something found in nature. This apparatus allows for the placement of ornaments, lights or other decorations in a plurality of locations or attachment points on the apparatus.

9 Claims, 7 Drawing Sheets

107

APPARATUS FOR HANGING OR DISPLAYING LIGHTS, ORNAMENTS, OR OTHER DECORATIVE ELEMENTS

CLAIM OF PRIORITY

A claim of priority is made to U.S. Provisional Application No. 61/670,902 filed Jul. 12, 2012. The contents of which are hereby incorporated by reference in its entirety.

BACKGROUND

During the winter holiday season there is a long-standing tradition of hanging decorative ornaments or lights from tree-shaped structures, often referred to as Christmas trees. Traditionally, such decorations where hung on actual conifer trees cut from nature. At some point, artificial Christmas trees were developed as synthetic alternatives. These trees were made from artificial materials and designed to replicate all of the characteristics of a real Christmas tree, including the tree's distinct shape. There have been a number of different artificial Christmas tree inventions, but from the outside, they have a distinctive appearance of looking like a tree. In addition all of these are based around the idea of a central trunk to which the external structure is attached. In addition, decorations are sometime hung on garland or wreathes. A key problem with both of those products is that they are not free-standing—they are hung on walls or draped over a pre-existing structure. In addition, garland has weak structural integrity and is unable to be rigid over any length.

SUMMARY

In an implementation, an apparatus is provided. The apparatus includes a base and a plurality of branches to create an artistic design. The apparatus may require assembly, and when assembled the apparatus becomes a rigid, stable and free-standing structure of a shape that does not naturally occur. The apparatus does not replicate something found in nature. This apparatus allows for the placement of ornaments, lights or other decorations in a plurality of locations or attachment points on the apparatus.

In another implementation, the apparatus includes a base, and a plurality of branches. The base is removably connected to the crossbar, each of the branches is removably connected to the crossbar, and each of the branches may or may not be substantially perpendicular to the crossbar.

The apparatus may combine a first element of a first tradition, and a second element of a second tradition. The first and the second elements are different and the first tradition may be different from the second tradition.

This summary is provided to introduce a selection of concepts in a simplified form that are further described below in the detailed description. This summary is not intended to identify key features or essential features of the claimed subject matter, nor is it intended to be used to limit the scope of the claimed subject matter.

BRIEF DESCRIPTION OF THE DRAWINGS

The foregoing summary, as well as the following detailed description of illustrative implementations, is better understood when read in conjunction with the appended drawings. For the purpose of illustrating the implementations, there is shown in the drawings example constructions; however, the implementations are not limited to the specific structures and instrumentalities disclosed. Moreover, the structures and features of the implementations shown in the drawings are not to scale, nor are they meant to limit the structures and features to any particular sizes or shapes. In the drawings:

FIG. 1 is an illustration of an example apparatus 100. The apparatus 100 is a stable, free-standing structure that allows for the hangings of lights, ornaments, or garland. The apparatus 100 may be easily assembled and disassembled by a user with or without tools. The apparatus is designed to remain stable while supporting the weight of the attached lights, ornaments and garland.

Figure 6:
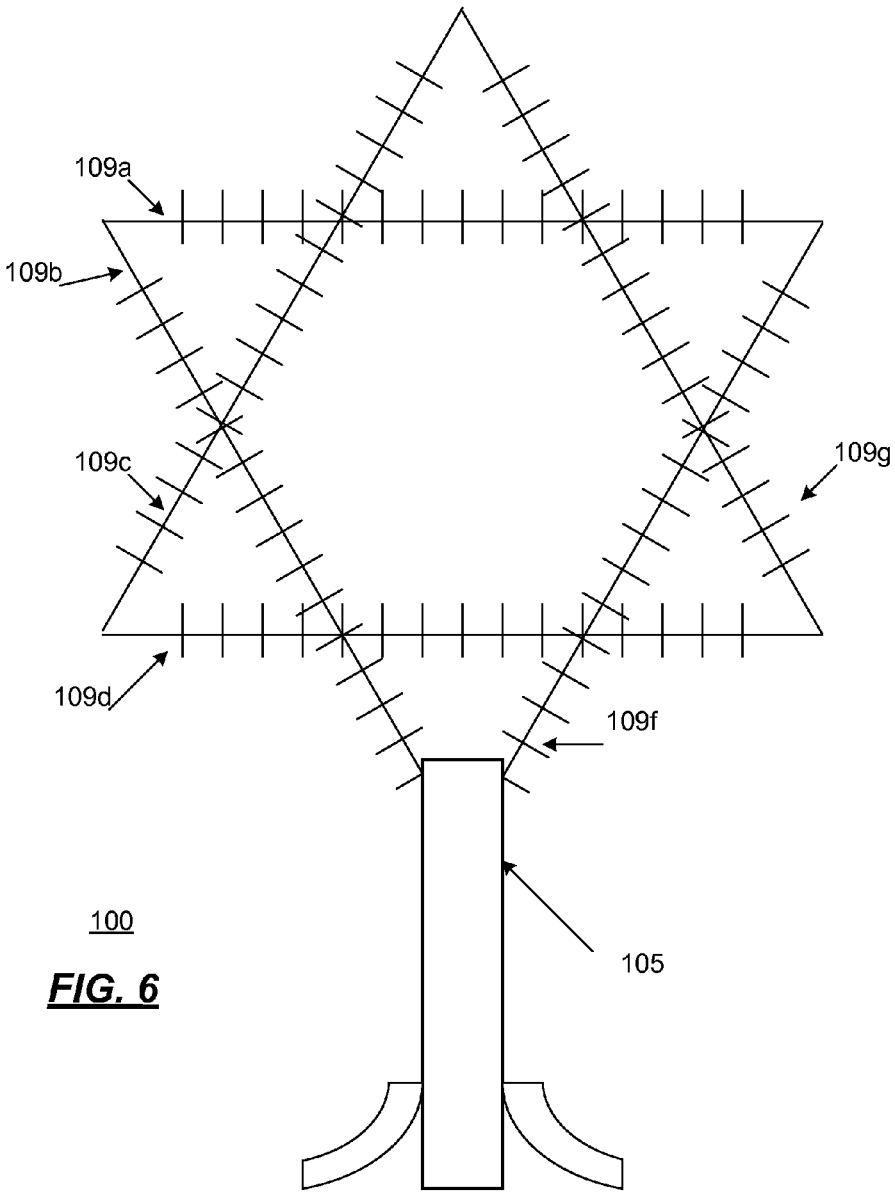
FIG. 6 is an illustration of a view of an additional example apparatus.
Figure 7:
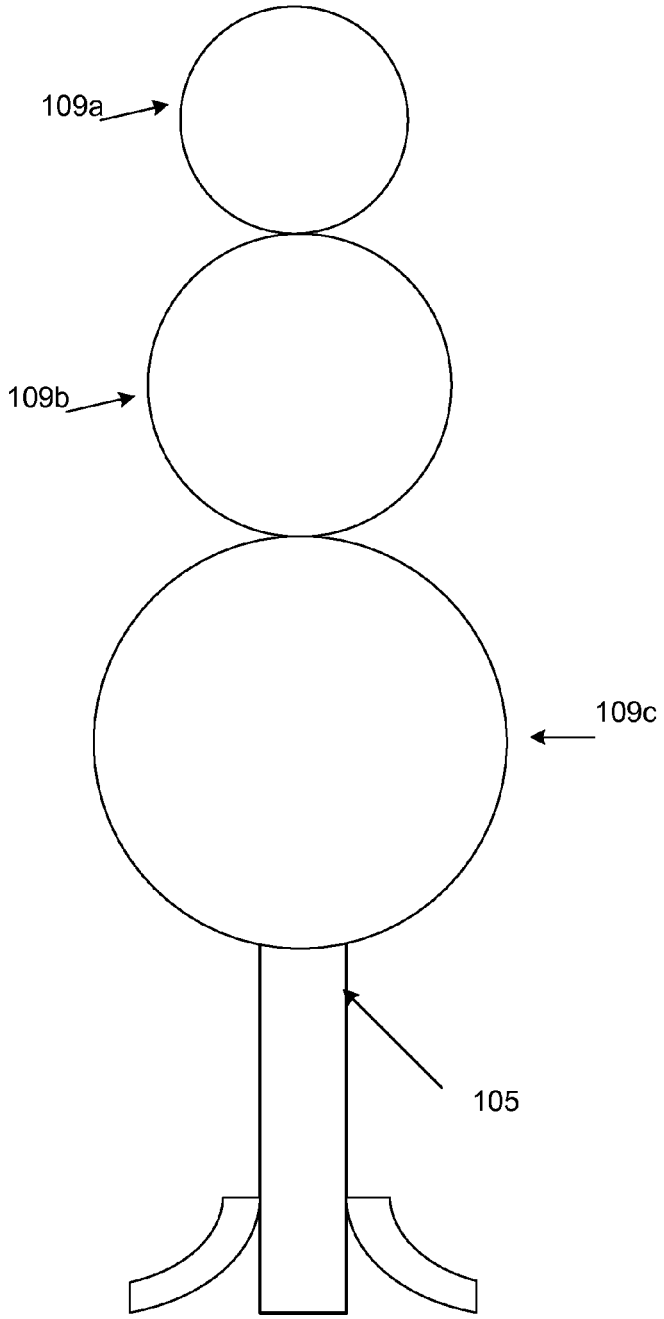
FIG. 7 is an illustration of a view of an additional example apparatus.

The apparatus 100 may further combine symbols from one or more traditions or religions into a single object or apparatus. For example, the apparatus 100 may combine the structure of the menorah from the Jewish tradition with the garland and/or decorations typically associated with Christmas trees from the Christian tradition. Other religions and/or traditions may be combined by the apparatus 100, such as the kinara of Kwanza, for example. Other examples of the apparatus 100 are shown in FIGS. 6 and 7. Alternatively, the apparatus 100 may combine no traditions, or may represent only a single tradition. In addition, as will be described further bellow, other user interests may be incorporated into the apparatus 100 such as sports teams, children's characters, favorite movies, television shows, music, and countries, for example.

In the example shown, the apparatus 100 includes a base 105 that supports a crossbar 107. The crossbar 107 is further connected to a plurality of substantially perpendicular branches 109*a*-109*i*, referred to herein collectively as the branches 109. In the example shown, there are nine branches 109 shown corresponding to the nine candles of the menorah using during the Hanukah holiday. Depending in the traditions being combined by the apparatus 100 there may be more or fewer branches 109. For example, where the apparatus 100 incorporates the Kwanza holiday, the apparatus 100 may include seven branches 109 corresponding to the seven candles of the Kinara. The branches 109 may be of similar or dissimilar lengths, and may or may not be perpendicular as shown. Alternatively, the apparatus 100 may not include a crossbar 107, and each branch 109 may connect directly to the base 105, or to each other, for example.

The apparatus 100, when constructed is further meant to be or resemble a form that is not based on a form that is found in nature or that is naturally occurring. For example, the apparatus 100 may not be the same form as a tree, such as a Christmas tree. Examples of forms that are not naturally occurring that may be used by the apparatus include, but are not limited to, a menorah, a kinara, a Star of David, a cross, and a snowman, for example.

Figure 1:
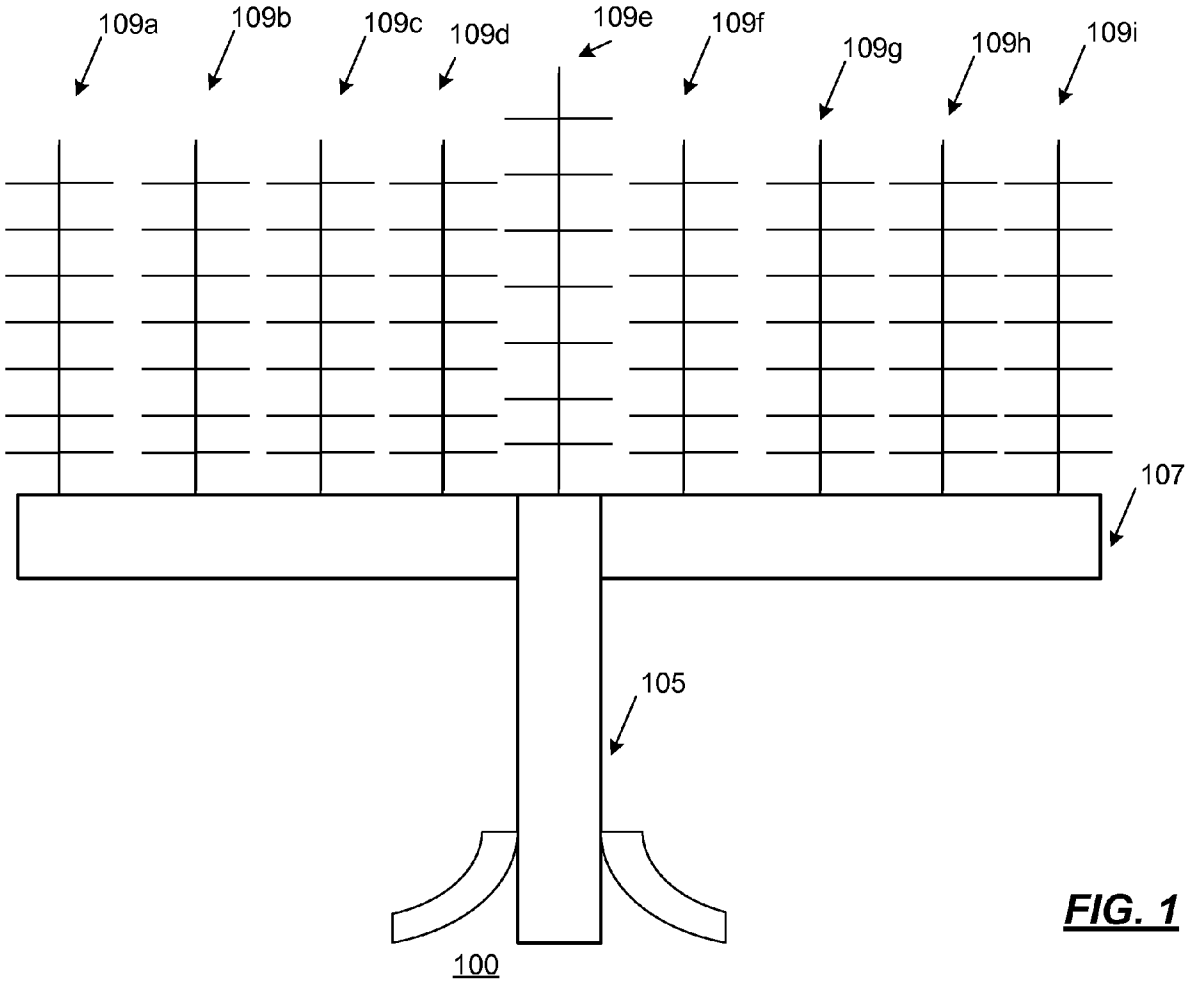
FIG. 1 is an illustration of a view of an example apparatus.
Figure 2:
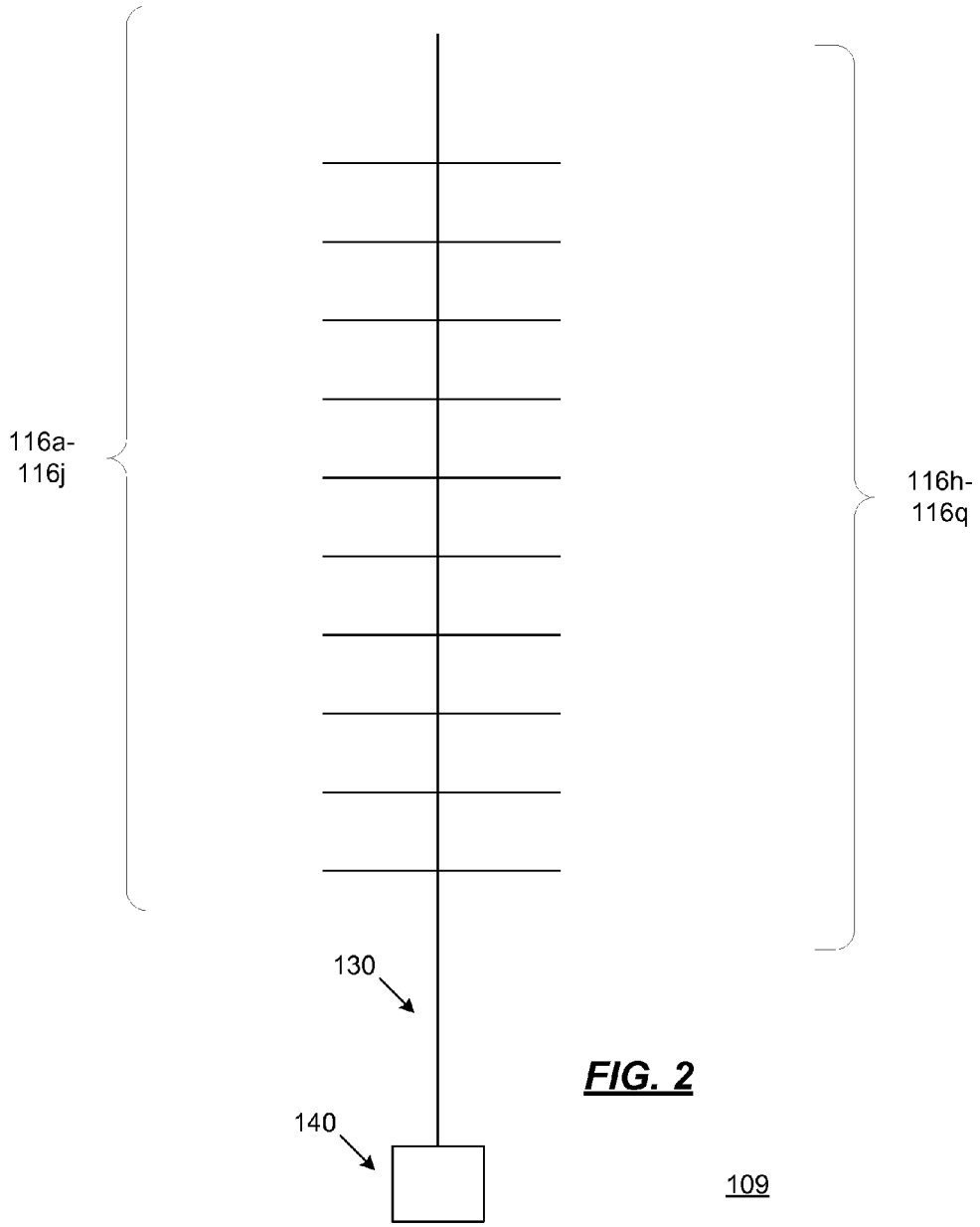
FIG. 2 is an illustrations of a view of an example branch.

FIG. 2 is an illustration of an example branch 109. As shown, the branch 109 includes a rigid shaft 130. The shaft 130 may be constructed from a variety of materials including, but not limited to, wood, metal, plastic, and rubber. Other materials or material combinations may be used.

The branch 109 further includes a plurality of attachment points 116*a*-116*j* and 116*h*-116*q*, collectively referred to as attachment points 116. The attachment points 116 may be used to support a variety of decorations on the branch 109 such as Christmas ornaments, lights, garland, etc. Other decorations or ornaments may be supported. In the example shown, the attachment points 116 are of a substantially uniform size and spacing with respect to the branch 109. However, in other implementations, the attachment points may be of different size, and may be non-uniformly distributed on the branch 109. In some implementations, rather than being part of the branch 109, the attachment points 120 may be integrated into garland or another decorative element. The garland may then be secured to the branch 109 using ties, clips, or other fasteners.

The attachment points 116 may be constructed from a variety of materials including, but not limited to, wood, metal, plastic, and rubber. Other materials or material combinations may be used. In some implementations, the attachment points 116 may be made from the same material as the shaft 130, and may be integrated into, or may be part of, the shaft 130. For example, the shaft 130 and attachments points 116 may be constructed as a single piece of plastic or metal and may be constructed during a single manufacturing process.

Alternatively, the shaft 130 and the attachment points 116 may be separate. In such implementations, the shaft 130 may be provided to a user with the attachment points 116 pre-installed, or the attachments points 116 may be provided separately for the user to insert into corresponding receptacles or holes on the shaft 130. Such a configuration may allow the user to customize the number of attachment points 116 that are on the branch 109.

The branch 109 may further include a connector 140 allowing the branch 109 to be easily connected to, or disconnected from, the crossbar 107 or base 105, thereby allowing the apparatus 100 to be easily assembled or disassembled. In some implementations, the connector 140 may be a male screw-type connector that may couple with a corresponding female screw-type connector on the crossbar 107, base 105, or other branch 109. Other types of fasteners and/or connectors may be used.

Figure 3:
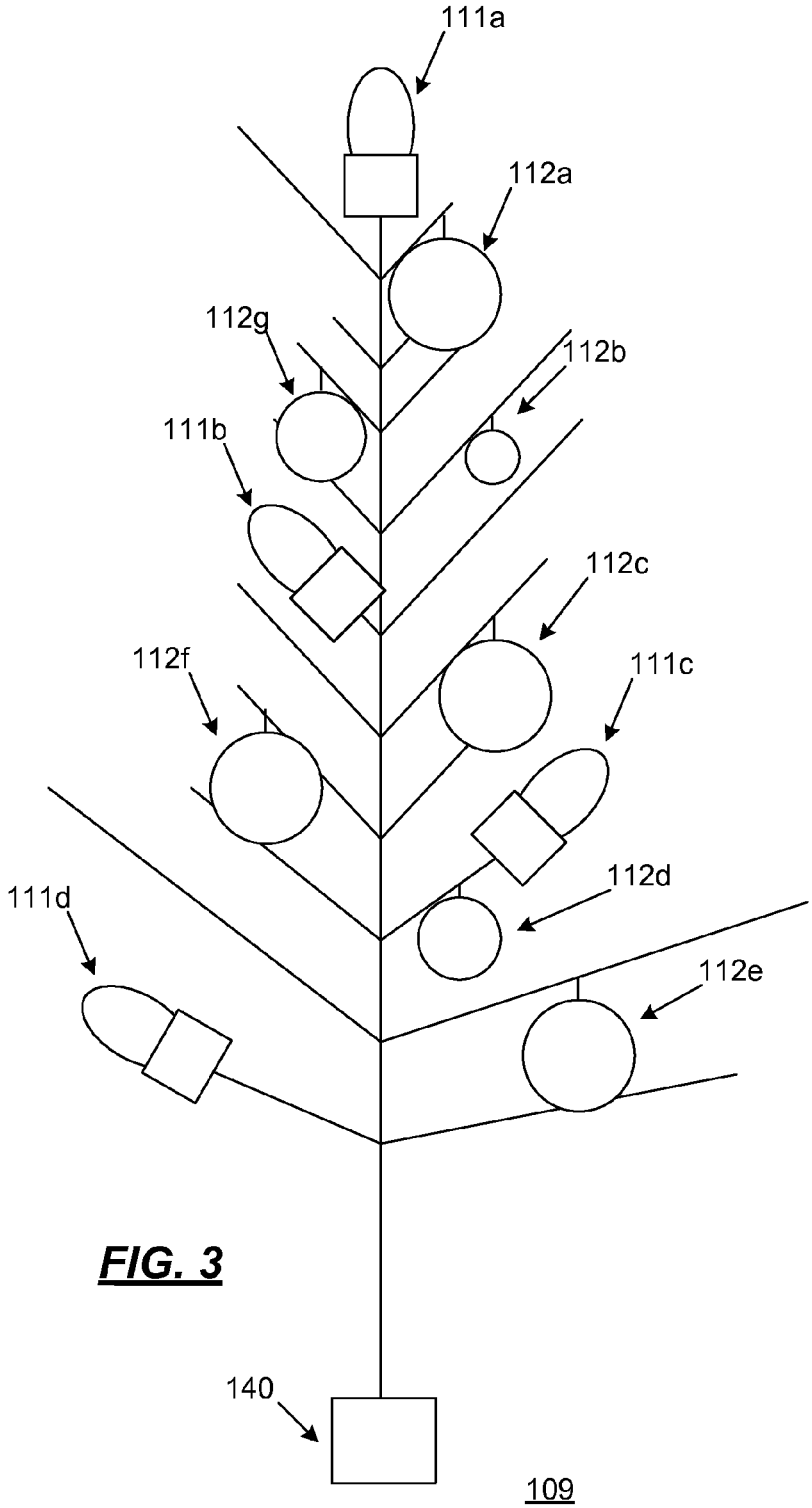
FIG. 3 is an illustration of a view of another example branch.

FIG. 3 is another illustration of an example branch 109. In the example shown, the branch 109 is meant to combine the candle of the menorah or the kinara, with the branch of the Christmas tree. The branch 109 includes a plurality of lights 111*a-d*, collectively referred to as lights 111, along with a plurality of ornaments 112*a-e*, collectively referred to as ornaments 112. More or fewer lights 111 and/or ornaments 112 may be supported by the branch 109. In addition, other types of ornaments 112 and/or lights 111 other than those shown may be supported. Garland may also be supported by the branch 109.

In some implementations, one or more of the ornaments 112 and/or garland may be integrated into the branch 109 and may be non-removable. For example, they may be made along with the branch 109 as part of the same manufacturing process. In other implementations, the ornaments 112 may be sold along with the apparatus 100, and/or a user of the apparatus 100 may supply their own ornaments 112. The ornaments 112 may then be attached to the branch 109 by the user on one or more of the attachment points 116.

Similarly to the ornaments 112, in some implementations, the lights 111 may be integrated into the branch 109 and may be non-removable. Alternatively, a housing or electrical connector may be integrated into the branch 109 allowing a user to replace light bulbs, or other lighting elements, associated with the lights 111. In such implementations, the shaft 130 may include internal or external wiring that extends into the lights 111 or housing. In addition, the wiring may connect to the connector 140, which may also be adapted to electrically couple with a corresponding connector on the crossbar 107, base 105, or other branch 109, for example.

As may be appreciated, the design of the branches 109 may allow users to "swap out" branches 109 from the apparatus according to user preferences. For example, a user may purchase branches 109 having different colors, light 111 designs, and ornament 112 styles. Branches 109 that feature designs that incorporate different names, sports teams, cities, countries, lifestyles, occupations, religions, etc. may also be supported and made available to users.

Figure 4:
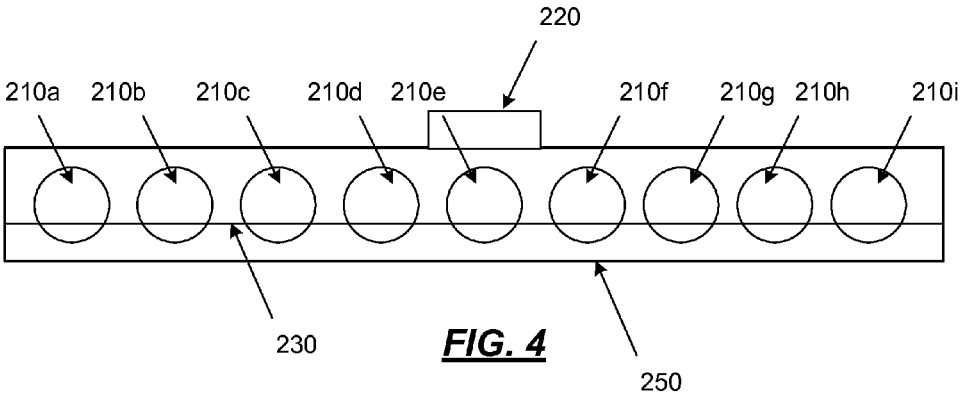
FIG. 4 is an illustration of a view of an example crossbar.

FIG. 4 is an illustration of an example crossbar 107. As illustrated the crossbar 107 includes a plurality of connectors 210*a*-210*i*, collectively referred to herein as the connectors 210. The connectors 210 may be adapted to connect to corresponding connectors 140 on the branches 109. For example, the connector 210 may be a female connector that matches a male connector 140, or vice versa. Any type of connector or connection means may be used. While nine connectors 210 are shown, it is for illustrative purposes only. There is no minimum or maximum number of connectors 210 that may be supported.

Depending on the implementation, one or more of the connectors 210 may include a conductive material that may allow the connectors 210 to electrically couple with the connectors 140 of the branches 109. The crossbar 107 may provide electricity to the lights 111 of the branches 109 through the connectors 210 and 140. In such implementations, the crossbar 230 may include wiring 230 that electrically connects the connectors 210 to a power source. The power source may be integrated into the crossbar 107, or as will be described further below, may be part of the base 105.

The crossbar 107 may be designed to be stable and support the weight of each of the branches 109 when connected. The crossbar 107 may constructed out of a variety of materials or material combinations including, but not limited to, plastic, metal, stone, and wood.

The crossbar 107 may further incorporate decorative elements that correspond to the particular holiday traditions being combined by the apparatus 100, and may allow for a user to periodically change the decorative elements. For example, the crossbar 107 may include a removable faceplate 250. Each faceplate 250 may feature designs that incorporate different names, sports teams, cities, countries, lifestyles, occupations, religions, etc.

The crossbar 107 may further include a connector 220 that may allow the connector 220 to be connected to the base 105. The connector 220 may allow the crossbar 107 and base 105 to be easily assembled or disassembled by a user. In implementations where the crossbar 107 provides electricity to the branches 109, the connector 220 may further provide electricity to the crossbar 107 from the base 105. Any type of connector may be used for the connector 220.

Figure 5:
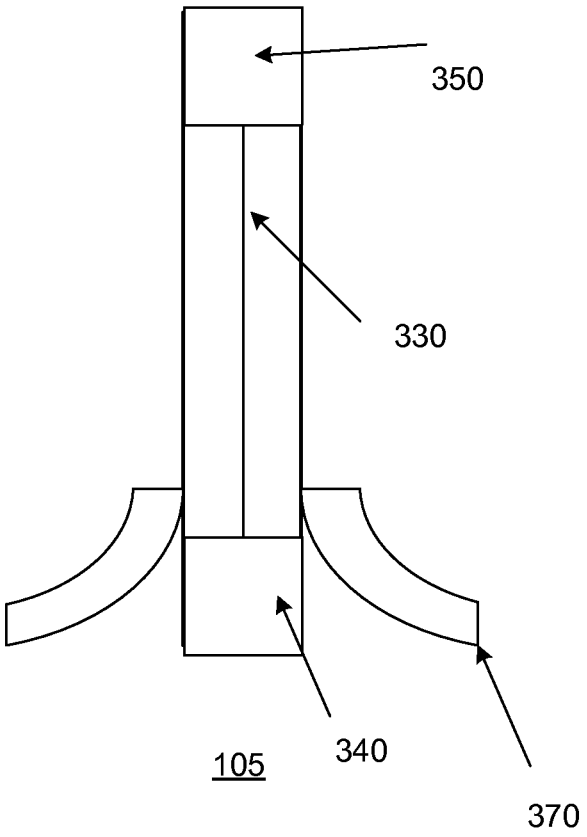
FIG. 5 is an illustration of a view of an example base.

FIG. 5 is an illustration of an example base 105. The base 105 may be connected to the crossbar 107 and may provide support and stability to the apparatus 100, especially when the branches 109 are connected to the crossbar 107. Alternatively, the base 105 may connect directly to the branches 109 and may similarly provide support and stability to the apparatus 100. The base 105 may be constructed using a variety of suitable materials and material combinations including, but not limited to, wood, plastic, metal, rubber, stone, etc. The weight and size of the base 105 may be selected to ensure that the apparatus 100 is stable when assembled, but can also easily be moved for purposes of disassembly, for example. In some implementations, the base 105 may include additional struts 370 for stability, or may have connectors allowing the base 105 to be securely fastened to a surface such as plywood, for example.

The base 105 may further include a connector 350. The connector 350 may allow the base to be removably connected to the crossbar 107 and/or the branches 109. In some implementations, the connector 350 may couple with a corresponding connector 220 on the crossbar 107 or the connector 140 of the branches 109. Any type of fasteners or connectors may be used.

The base 105 may further include a power source 340. The power source 340 may include a variety of power source types such as battery, line power, solar power, etc. In some implementations, the power supply 340 may couple with wiring 330 to deliver power to the connector 350. The connector 350 may then provide power to the crossbar 107, which in turn may provide power to the lights 111 of the branches 109. Alternatively, the connector 350 may provide power directly to the branches 109.

FIG. 6 is an illustration of another apparatus 100. In the example shown, the apparatus 100 includes a plurality of branches 109*a-g* and a base 105, but does not include a crossbar 107. As shown, each of the branches 109 is connected to another branch, while the branches 109*f* and 109*b* are also connected to the base 105. The apparatus 100 is in the form of a Star of David from the Jewish tradition. A user may use the attachment points of the branches 109 to hang ornaments, lights, or garland. Alternatively, one or more of the garland, ornaments, and or lights may be integrated or formed directly into each of the branches 109.

FIG. 7 is an illustration of another apparatus 100. In the example shown, the apparatus 100 includes a plurality of branches 109*a-c* and a base 105, but does not include a crossbar 107. The apparatus 100 is in the form of a snowman which is a secular symbol. A user may use the attachment points (not shown) of the branches 109*a-c* to hang ornaments, lights, or garland, thus incorporating elements of the Christmas tree with the secular snowman form. Alternatively, one or more of the garland, ornaments, and/or lights may be integrated or formed directly into each of the branches 109.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. An apparatus consisting of:

a base comprising a top portion and a bottom portion;

a crossbar comprising nine branch connectors arranged across a top portion of the crossbar and a base connector arranged on a bottom portion of the crossbar, the base connector adapted to removably connect with the top portion of the base; and nine branches, wherein each branch is adapted to removably connect with one of the nine branch connectors of the crossbar, wherein each branch, when removably connected to the crossbar, is substantially perpendicular to the crossbar and is substantially parallel to the other branches, wherein the base, crossbar, and nine branches when connected form a stable structure that is not based on a structure that is found in nature.

2. The apparatus of claim 1, wherein each branch further comprises a plurality of removable attachment points, and each removable attachment point is adapted to support one or more of an ornament or a light.

3. The apparatus of claim 1, wherein each branch further comprises of a plurality of lights, and each branch is electrically connected to the base or another branch.

4. The apparatus of claim 1, wherein the apparatus further consists of a power source, and the base or a branch is electrically connected to the power source.

5. The apparatus of claim 1, wherein the apparatus further consists of an element from a first tradition and an element of a second tradition, wherein the first tradition and the second tradition are different.

6. The apparatus of claim 5, wherein the element of the first tradition is a Christmas tree, and the element of the second tradition is a Hanukah menorah.

7. The apparatus of claim 1, wherein each branch further comprises a plurality of ornaments.

8. The apparatus of claim 1, wherein each branch further comprises a plurality of attachment points.

9. The method of claim 1, wherein each branch further comprises garland integrated into the branch.

* * * * *